United States Patent [19]

Bemis et al.

[11] 4,213,211

[45] Jul. 22, 1980

[54] TOILET SEAT ELEVATOR DEVICE

[75] Inventors: Richard A. Bemis; John E. Rummele, both of Sheboygan, Wis.

[73] Assignee: Bemis Manufacturing Company, Sheboygan Falls, Wis.

[21] Appl. No.: 723,381

[22] Filed: Sep. 15, 1976

[51] Int. Cl.[2] ..... A47K 13/06; A47K 13/12

[52] U.S. Cl. ..... 4/239; 4/240; 4/235

[58] Field of Search ..... 4/1, 237, 239, 240, 4/254, DIG. 5, 235

[56] References Cited

U.S. PATENT DOCUMENTS

| | | | |
|---|---|---|---|
| 756,897 | 4/1904 | Rutledge | 4/239 |
| 2,461,160 | 2/1949 | Joyce | 4/235 |
| 2,810,914 | 10/1957 | Hamilton | 4/1 |
| 2,980,922 | 4/1961 | Taylor | 4/235 |
| 3,210,777 | 10/1965 | Katoh | 4/239 X |
| 3,405,411 | 10/1968 | Brown | 4/254 |

*Primary Examiner*—Charles E. Phillips
*Attorney, Agent, or Firm*—Fred Philpitt

[57] ABSTRACT

A toilet seat elevator device which is adapted to be pivotally attached to a toilet bowl and to pivotally support a toilet seat on its upper surface.

1 Claim, 7 Drawing Figures

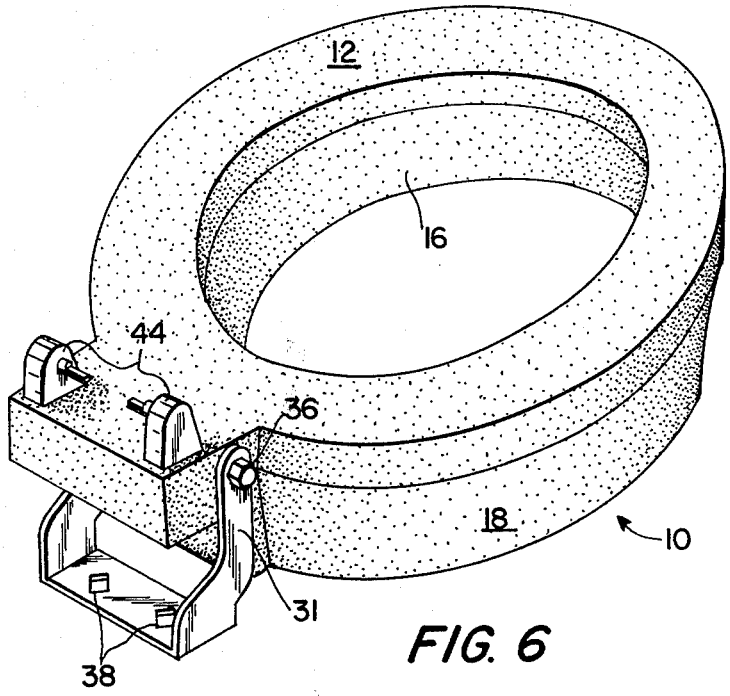
FIG. 6
FIG. 7
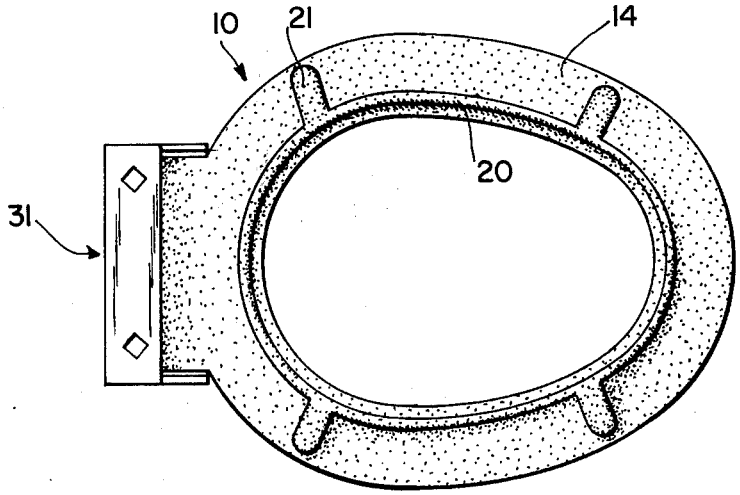

TOILET SEAT ELEVATOR DEVICE

BACKGROUND

Throughout their history toilet bowls have been manufactured in many different sizes and shapes. In recent years the plumbing industry has become conscious of the necessity for the interchangeability of products and thus the dimensions of the bowl have become increasingly limited by consensus standards. One of the standards dictates that the seat on a toilet bowl, where horizontal, be located between 15 and 16 inches above the floor. The 15–16 inch level is normal for residential and commercial bowls and is acceptable to the majority of people.

However, there are many people with physical limitations and afflictions that make the use of a 15–16 inch high toilet seat very uncomfortable, if not impossible. These handicapped people need a seat raised 4–5 inches higher. To meet this need, various seat elevator arrangements have been developed. These elevators raise the level of the horizontal seat and reduce the bending required to effectively use the bowl. Normally a seat elevator will raise the level of the seat 4–5 inches.

Toilet bowl elevators of various sorts have been commercially available for many years, one of the first being patented by Lord (U.S. Pat. No. 1,674,116) in 1928. To date, all seat elevators that have been patented must be attached to the bowl in such a way that the bowl is then restricted in its use or the elevator simply sits on the bowl. Elevators that are bolted to the bowl either through the conventional seat attachment holes or to the annular rim around the top of the bowl create many hard-to-clean areas between the bowl and the elevator while adding moisture and dirt collecting areas in the elevator itself. The result is an unsanitary attachment to the water closet bowl. By bolting the elevator to the rim or tail of the bowl its use is thereafter restricted to seated endeavors. The possible use of the bowl as a standing urinal is eliminated.

Seat elevators that merely sit on the bowl or are attached by clips are easily removed for cleaning, but they tend to be unstable. Especially considering the limitations of the person disposed to use an elevator, stability and security are of primary importance. Also, once removed there is usually no convenient or sanitary location to set the elevator.

THE PRESENT INVENTION

The present invention relates to improvements in a toilet seat elevator whereby the elevator can be securely fastened to the water closet bowl, yet the bowl may still be used as a standing urinal. In addition, no concealed or hard-to-reach fouling surfaces are created by the elevator, thus eliminating potential problem cleaning areas and reducing the amount of maintenance time.

The principal object of the invention is to provide a toilet seat elevator that can pivot in such a way as to allow the toilet assembly to be used as a seat when in the horizontal or down position and used as a urinal when pivoted to the vertical or raised position. A unique mounting bracket assembly with cantilevered leaves allows the 4–5 inch thick water closet bowl elevator to rest in a vertical or raised position by simply lifting the elevator as you would a common water closet seat and resting the elevator against the water closet tank.

Another object of the invention is to provide a toilet seat elevator that can accept any toilet seat with the standard 5½ inch center-to-center hinge post separation. The prior art restricts the user to certain types or styles of seats. With the present invention the user may add any seat of comfortable contour, choice of color or, if desired a water closet seat assembly with self-contained support arms (U.S. Pat. No. 3,405,411) which would further aid a handicapped person. The strength and design of all members of the invention are coordinated to accept a seat with self-contained arms presently marketed as "Medic-Aid" or a similar type seat assembly.

Further, the toilet seat elevator and the seat are each provided with their own pivoting means, and thus may be raised and lowered either separately or together. The seat may be raised separately and rested against the water closet tank for ease in cleaning the top of the elevator and the bottom of the seat. The seat and seat elevator may be raised together to use the bowl as a urinal and to clean under the elevator. Further, a seat with a "self-sustaining" hinge may be provided so that it will remain in any position desired. A "self-sustaining" hinge creates friction sufficient to sustain the seat, when pivoted to whatever angle is desired. The seat will hold at 30° or 60°; it does not have to be in a full up or full down position.

Further, the toilet seat elevator may be provided with the "self-sustaining" feature freeing both hands of the user for cleaning while the seat elevator and seat remain in the desired position. The "self-sustaining" feature would be a necessary addition for any user who had a tank that protruded inordinately forward or a seat that is unusually thick, thus negating the cantilever effect of the mounting assembly bracket.

An object of the invention is to provide a hinged, pivotable seat elevator to permit the user to take advantage of the conventional seated position and to also provide easy conversion to an uncovered bowl most convenient for a male's use as a standing urinal. Further, the elevator because of its design, materials and construction is much more easily maintained in a sanitary condition.

Federal, state and local codes and regulations have continually emphasized the importance of water closet bowls and attachments thereto which are impervious to moisture and that contain no recesses, slots, holes or other fouling surfaces. The necessity of maintaining a water closet bowl and its attachments in a clean and sanitary condition has been, for the most part, overlooked in previous art. Our invention is the first securely mounted water closet bowl extension that is able to pivot a 90° vertical position and is free from fouling surfaces.

The ability of our seat elevator to pivot allows the user to clean all sides of the elevator with a minimum of contortions. The smooth impervious surface and one-piece design eliminates any unnecessary dirt and moisture in the cracks or seams. Positioning feet, commonly called cushions or bumpers and inside wall drip flashing are molded into the one-piece elevator. The hollow cylinder running transversely and vertically through the extended back of the seat elevator is molded into the elevator rather than drilled as are the horizontal cylinders on either side of the extended back used for fastening a conventional toilet seat to the elevator. The molded holes maintain the integrity of the unit and eliminate the possibility of moisture and dirt collecting in the hollow or foamed inside. Thus, the seat elevator is an air-tight, moisture-proof unit.

To further facilitate the cleanability the inner side walls of the elevator diverge outwardlyy thus reducing the possibility of being fouled by use. The outward divergence of the back side of the inner wall is greatest because it is the most commonly fouled.

The seat elevator has no sharp angles or deep recesses to trap dirt or moisture. The rounded tail piece permits unencumbered pivoting from lower to raised position and contributes to the overall ease of cleaning.

The U-shaped cantilevered hinge assembly is designed to work integrally with the seat elevator. It is made of a material strong enough to support all of the optional types of toilet seats that could be mounted on the seat elevator, preferably plastic coated steel or stainless steel. The exterior surface must be corrosion resistant or coated with a substance that would keep the hinge assembly corrosion resistant, smooth, and impervious to moisture.

For added strength and the previously mentioned cleanability feature, the hinge assembly is a single piece of metal formed in such a way that the two leaves onto which the seat elevator is connected, project upward and forward. Location of the seat elevator pivot point is 3–4 inches above and 1–2 inches forward of the cantilevered mounting bracket assembly attachment holes.

The cantilevered mounting bracket assembly is designed to be flush on the top of the back side of the bowl and is secured to the bowl with two carriage bolts. Carriage bolts have smooth heads that recess into the mounting bracket assembly, eliminating another possible area of dirt and moisture retention.

The seat elevator is attached to the cantilevered mounting bracket assembly by means of a stainless bolt. The bolt runs through the holes provided in the cantilevered leaves of the mounting bracket assembly and through the horizontaltransverse hole molded through the extended back section of the seat elevator. On each end of the threaded bolt, blind acorn nuts or similarly threaded end caps are provided to eliminate exposed threads as a fouling source. The seat elevator must be light weight to facilitate lowering and raising. It must be rigid enough to withstand the weight of a user lowering and raising himself to and from an attached water closet seat assembly with self-contained support arms. It must be resilient enough to keep from damaging the bowl when dropped from a vertical to a horizontal position, and it must have an exterior finish that is smooth, impervious to moisture and common bowl cleaning agents.

To fulfill the above requisites the seat elevator should be made from a moderately priced molded plastic, preferably polyethylene, although polystyrene, certain self-skinning urethanes and other moldable plastics are acceptable. The method of manufacture to achieve the most acceptable product is roto-molding, although blow molding any of the above listed plastics or injection molding with self-skinning expanded urethane foam would also be acceptable.

One embodiment of our invention will now be illustrated by reference to the attached drawings wherein:

FIG. 6 is an assembled view of the elevator assembly shown in FIG. 1; and FIG. 7 is a bottom view of FIG. 6.

Figure 1:
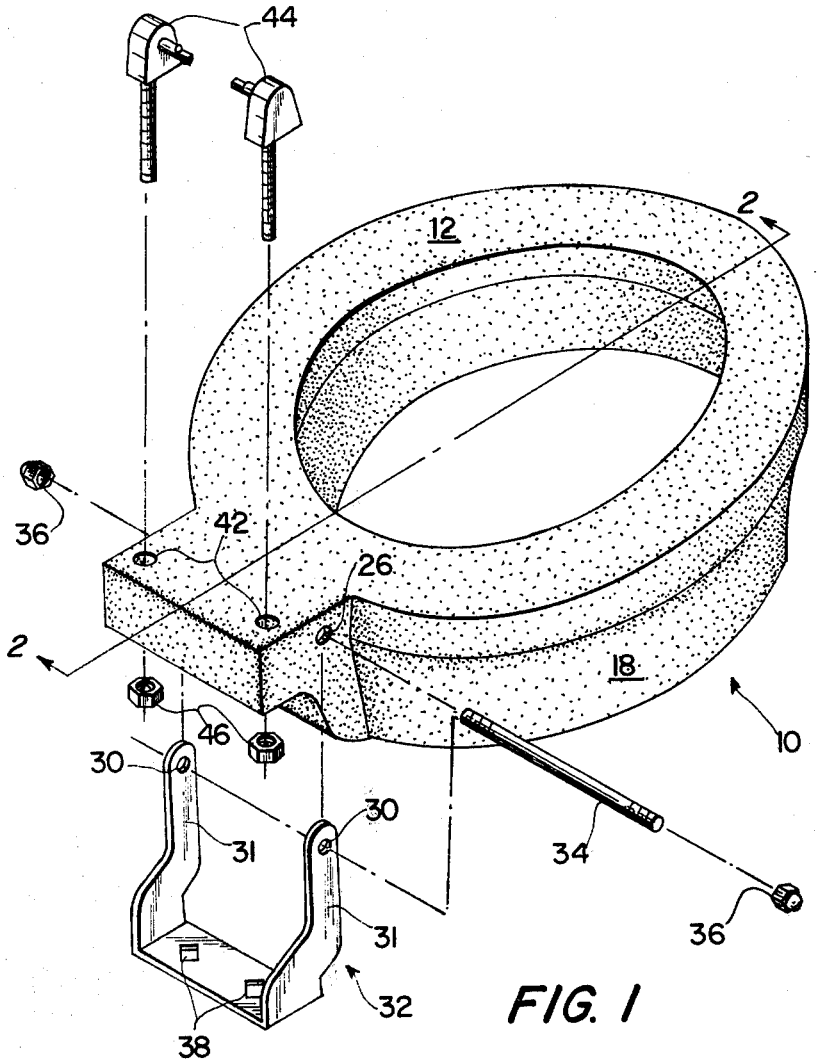
FIG. 1 is an exploded view of an elevator assembly.
Figure 2:
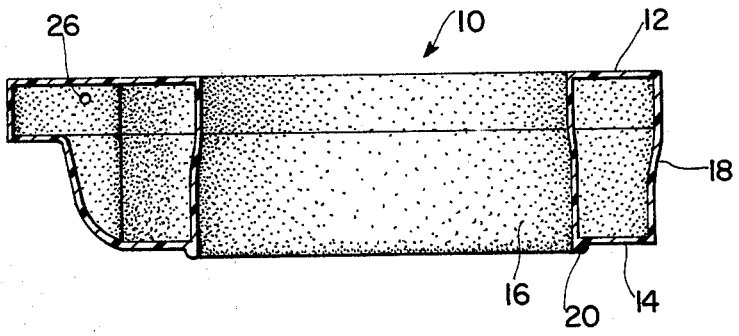
FIG. 2 is a view through 2—2 of FIG. 1.

FIGS. 1, 6 and 7 show the generally ring-shaped tubular elevator member 10 that has a generally elliptical opening. The elevator member 10 includes an upper surface 12, a lower surface 14, and side walls 16 and 18 extending between said upper and lower surfaces. The height of the side walls may vary between about 3 and 6 inches. The inside wall 16 preferably diverges outwardly in a downward direction. At the point where the inside side wall 16 and the bottom surface 16 join a circumferential lip 20 is preferably provided. A plurality of feet 21 extending outwardly from the lip 20 are preferably provided.

Figure 3:
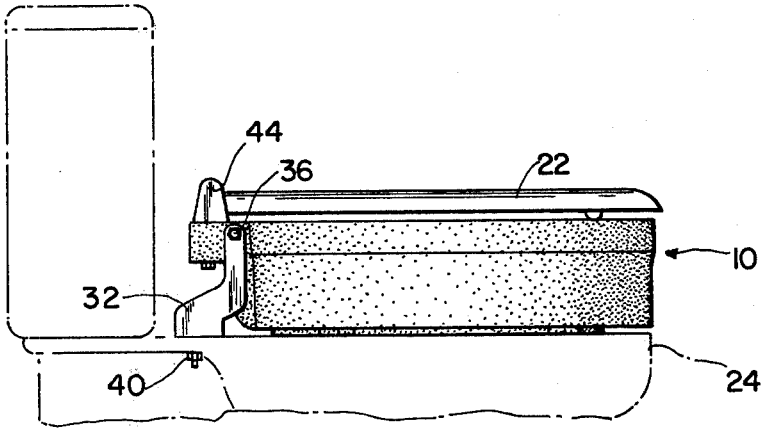
FIGS. 3, 4 and 5 are side views showing an elevator and seat assembly in three possible positions.
Figure 4:
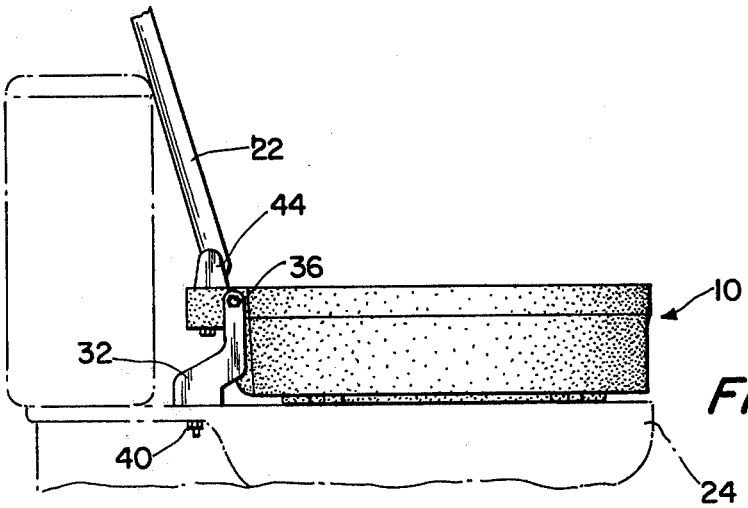

The seat elevator member 10 has an integral part thereof a rearwardly extending section that contains means for connecting said elevator member to both (a) the toilet bowl 24 upon which the lower surface 14 of the elevator member is to rest and (b) the toilet seat 22 that is to be supported by the upper surface 12 of the elevator member. More specifically, this rearwardly extending section has an elongated horizontal opening 26 therein having ends which correspond in width to the holes 30 in a U-shaped bracket member 32. When holes 30 are aligned with opening 26 and a bolt 34 with threaded ends passed therethrough, the U-shaped bracket member 32 can be fixed in place by tightening blind acorn nuts 36. However, even when the nuts 36 are tightened, the rearwardly extending section is free to pivot as is shown in FIGS. 3, 4 and 5.

Figure 5:
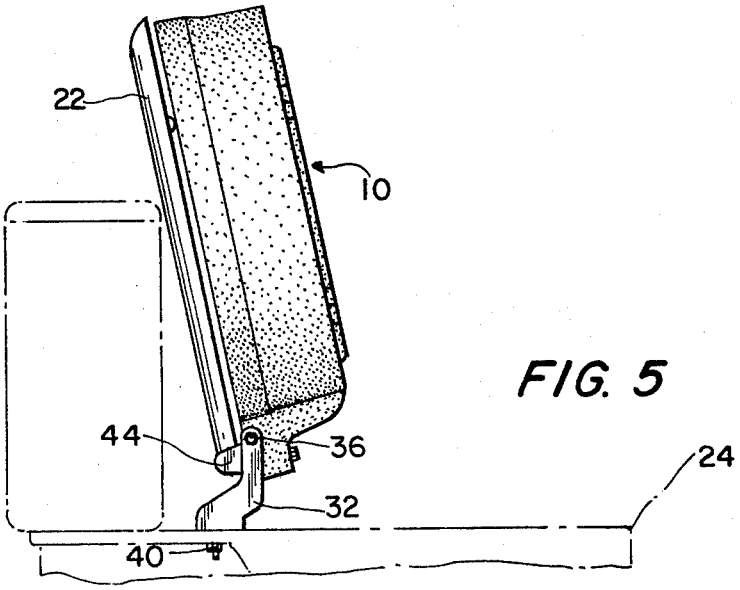

The U-shaped bracket member 32 has cantilevered leaves 31 which allow the elevator 10 to rest in a vertical position by simply lifting the elevator as shown in FIG. 5.

The U-shaped bracket member 32 has two openings 38 therein that are spaced apart the same distance as the standard distance between the openings in the toilet bowl through which seat bolts are normally passed ($5\frac{1}{2}$ inches). The U-shaped bracket member 32 can therefore be securely fastened to the toilet bowl 24 by bolts 40.

The aforesaid rearwardly extending section of the elevator member 10 also is provided with two vertical passageways 42 five and a half inches apart which are adapted to receive two mounting posts 44 for the toilet seat 22. Nuts 46 secure posts 44 after the toilet seat 22 has been fixed between the posts.

FIG. 3 shows the elevator member and its overlying toilet seat in its "down" position. FIG. 5 shows the toilet seat and the seat elevator member in its "raised" position so that the toilet can be used as a urinal. FIG. 4 shows an intermediate position with only the toilet seat raised. The variety of positions possible with the seat and the seat elevator member permit easy and complete cleaning.

In conclusion, while the foregoing specification and drawing describe the construction, operation and use of one preferred embodiment of the instant invention, it is to be understood that we do not intend to limit ourselves to the precise constructions and arrangements herein disclosed, since the various details of construction, form and arrangement may obviously be varied to a considerable extent by anyone skilled in the art without really departing from the basic principles and novel teachings of this invention and without sacrificing any of the advantages of the invention, and accordingly we intend to encompass all changes, variations, modifications and equivalents falling within the scope of the appended claims.

What we claim is:

1. A toilet seat elevator assembly comprising in combination (A) a generally ring-shaped tubular elevator member:

(1) having a shaped upper surface that in plan view approximates the shape of a toilet seat and which is adapted to support a toilet seat thereon, (2) having a shaped lower surface that approximates the shape of a toilet seat bowl and which is adapted to rest on the top of a toilet seat bowl, (3) having side walls extending between said upper surface and said lower surface, said side walls having a height of between about 3 and 6 inches, (4) having as an integral part thereof a rearwardly extending section that contains means for connecting said elevator member to both a toilet bowl upon which the lower surface of the elevator member is to rest and to a toilet seat that is to be supported by the upper surface of the elevator member, said means including an elongated passageway extending completely through said rearwardly extending section, (B) connector means for connecting said elevator member to a toilet bowl, said connector means including (1) a flat horizontally disposed section of metal having two spaced apart holes therein which are spaced apart the same distance as the standard distance between the openings in the toilet bowl through which seat bolts are normally passed, (2) a cantilevered leaf extending vertically upward and forwardly from each end of said flat horizontally disposed section of metal, each of said leaves having a hole in the upper portion thereof, said holes being horizontally aligned with each other along a line which is in front of the forward edge of said flat horizontally disposed section of metal, and (C) an elongated bolt extending through the elongated passageway set forth in (A)(4) and through the horizontally aligned holes of the forwardly cantilevered leaves set forth in (B)(2), whereby when said elevator member is attached to a toilet bowl by said connector means said elevator member can be pivoted from a substantially horizontal "down" position through an arc exceeding 90° to a generally vertical "up" position.

* * * * *